US011746616B2

(12) United States Patent
Burke et al.

(10) Patent No.: US 11,746,616 B2
(45) Date of Patent: Sep. 5, 2023

(54) FRAC PLUG WITH ROD PLUG

(71) Applicants: Seth Burke, Spring, TX (US); Eugene Stolboushkin, Houston, TX (US)

(72) Inventors: Seth Burke, Spring, TX (US); Eugene Stolboushkin, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 25 days.

(21) Appl. No.: 17/133,972

(22) Filed: Dec. 24, 2020

(65) Prior Publication Data

US 2022/0205334 A1 Jun. 30, 2022

(51) Int. Cl.
*E21B 33/129* (2006.01)
*E21B 33/12* (2006.01)

(52) U.S. Cl.
CPC ..... *E21B 33/1204* (2013.01); *E21B 33/1291* (2013.01)

(58) Field of Classification Search
CPC ..... E21B 33/1204; E21B 33/1291
See application file for complete search history.

(56) References Cited

U.S. PATENT DOCUMENTS 2,678,101 A * 5/1954 Thaxton ..... E21B 23/06 166/134
6,394,180 B1 5/2002 Berscheidt et al.
7,900,696 B1 * 3/2011 Nish ..... E21B 33/1294 166/376
10,352,128 B1 * 7/2019 Saraya ..... E21B 33/1293
10,808,479 B2 10/2020 Dirocco
2004/0045723 A1 * 3/2004 Slup ..... E21B 33/134 166/387
2008/0128133 A1 * 6/2008 Turley ..... E21B 43/26 166/123
2011/0315403 A1 * 12/2011 Nard ..... E21B 33/128 166/387
2014/0196952 A1 * 7/2014 Schicker ..... E21B 7/24 175/56
2018/0051532 A1 2/2018 Smith et al.
2020/0149381 A1 5/2020 Ring et al.
2020/0190928 A1 6/2020 King et al.
2020/0277838 A1 9/2020 Hern et al.
2021/0254428 A1 * 8/2021 Roessler ..... E21B 23/0413
2021/0277741 A1 * 9/2021 Xue ..... E21B 33/134

OTHER PUBLICATIONS

International Search Report and Written Opinion Issued in International Application No. PCT/US2021/063308 dated Apr. 12, 2022; 8 Pages.

* cited by examiner

*Primary Examiner* — Taras P Bemko
*Assistant Examiner* — Ronald R Runyan
(74) *Attorney, Agent, or Firm* — Cantor Colburn LLP

(57) ABSTRACT

A frac plug system for use in a wellbore, including a frac plug; and a plug member configured to set the frac plug in the wellbore and to control a flow of fluid through the frac plug once the frac plug is set in the wellbore. A method of controlling a flow of fluid within a wellbore, including conveying a frac plug system in the wellbore, the frac plug system including a frac plug and a plug member; setting the frac plug in the wellbore using the plug member; and control the flow of fluid through the frac plug using the plug member once the frac plug is set in the wellbore.

16 Claims, 6 Drawing Sheets

FRAC PLUG WITH ROD PLUG

BACKGROUND

In the resource recovery industry, a frac plug is generally used to direct fluid flow through a casing of a wellbore. A frac plug is disposed in the wellbore and a ball is dropped onto a ball seat of the frac plug to sit on the ball seat to redirect or stop fluid flow in a downhole direction. However, flowback can push the ball out of the ball seat and to a distance far from the frac plug. It is desirable to be able to have the ball near the frac plug, even during flowback, in order to be able to control fluid flow.

SUMMARY

An embodiment of a frac plug system for use in a wellbore, including a frac plug; and a plug member configured to set the frac plug in the wellbore and to control a flow of fluid through the frac plug once the frac plug is set in the wellbore.

A method of controlling a flow of fluid within a wellbore, including conveying a frac plug system in the wellbore, the frac plug system including a frac plug and a plug member; setting the frac plug in the wellbore using the plug member; and control the flow of fluid through the frac plug using the plug member once the frac plug is set in the wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
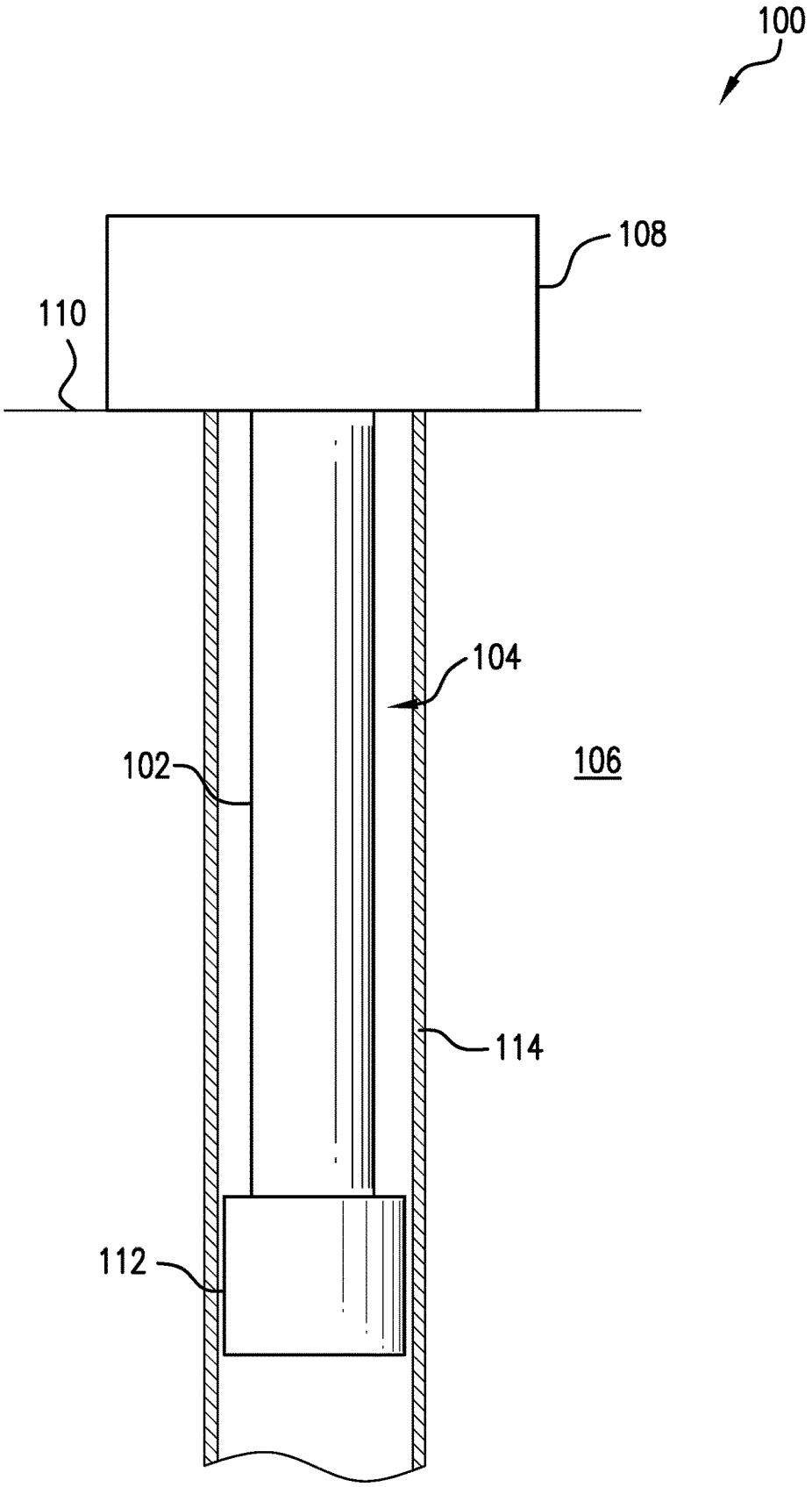
FIG. 1 shows a resource exploration and recovery system in accordance with an illustrative embodiment.

Referring to FIG. 1, a resource exploration and recovery system 100 is shown in accordance with an illustrative embodiment. The resource exploration and recovery system 100 can include well drilling operations, completions, resource extraction and recovery, $CO_2$ sequestration, etc. The resource exploration and recovery system 100 includes a string 102 disposed in a wellbore 104 formed in a formation 106. the wellbore 104 can be cased or uncased. The string 102 extends from a surface system 108 at a surface location 110. A downhole tool 112 is disposed at a bottom end of the string 102. The string 102 and/or downhole tool 112 can be operatively controlled by control system (not shown). In various embodiments, the downhole tool 112 can include a frac plug system that can be selectively engaged with a wall or casing 114 in the wellbore 104.

Figure 2:
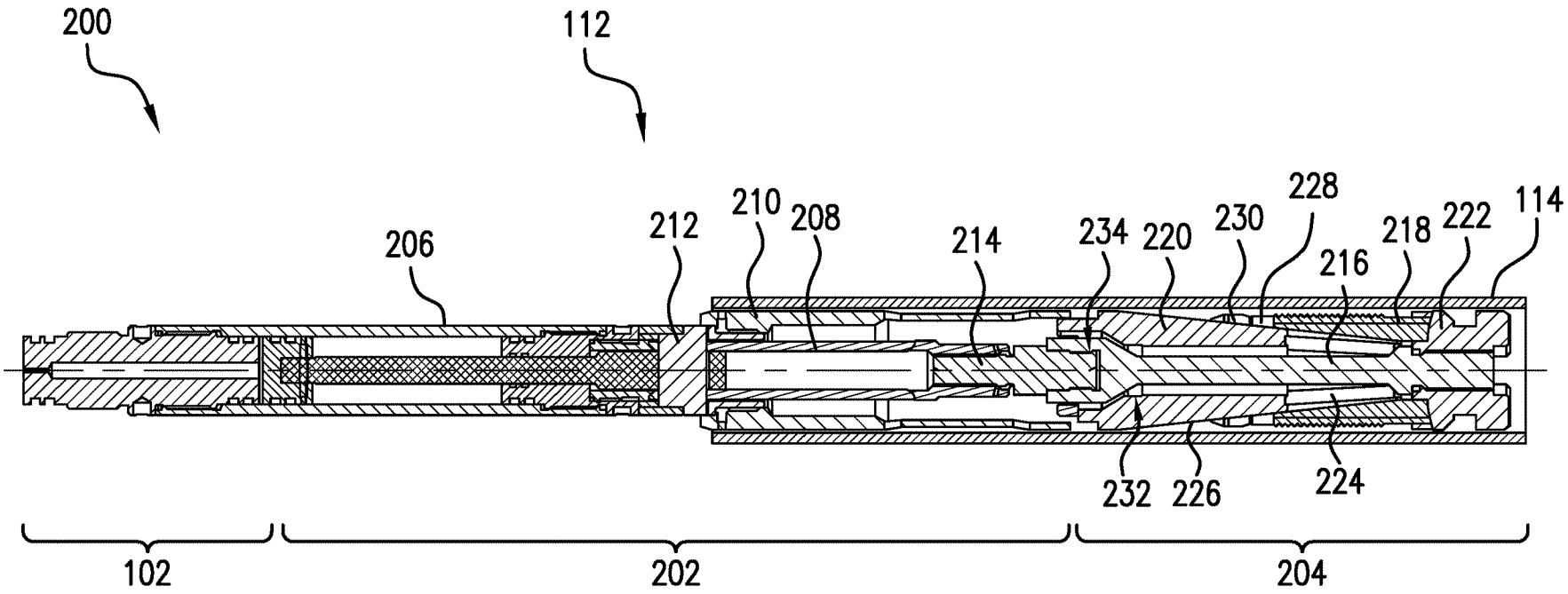
FIG. 2 shows a detailed view of a downhole tool of the resource exploration and recovery system.

FIG. 2 shows a detailed view 200 of the downhole tool 112, in an embodiment. The left side of the downhole tool 112 is referred to at times herein as a first end or top end and the right side of the downhole tool 112 is referred to at times herein as a second end or bottom end. For any component of the downhole tool 112, a first end or top end refers to a left-most end of the component as shown in the Figure and a second end or bottom end refers to a right-most end of the component as shown in the Figure.

The downhole tool 112 includes a setting tool 202 and a frac plug system 204. The setting tool 202 is disposed between a bottom end of string 102 and the frac plug system 204. During deployment, the frac plug system 204 is conveyed to a selected location in the wellbore 104 via the string 102. The setting tool 202 can be controlled to perform an operation that installs the frac plug system 204 in the wellbore 104. The setting tool 202 can then separate itself from the frac plug system 204, once installed, to leave the frac plug system 204 at the selected location in the wellbore 104.

The setting tool 202 includes a running tool 206, mandrel 208, housing 210 and actuator 212. The mandrel 208 is connected to the running tool 206 at a first end of the mandrel 208. The actuator 212 is coupled to the running tool 206 and the housing 210 and operates to move the housing 210 along a longitudinal axis of the downhole tool 112 relative to the mandrel 208. To set the frac plug system 204, the mandrel 208 is maintained at a constant location within the wellbore 104 as the housing 210 moves relative to the mandrel 208 and wellbore 104.

The frac plug system 204 includes a setting rod 214 and a plug member 216 extending longitudinally along the frac plug system 204. The setting rod 214 couples to a bottom end of the mandrel 208 and to a top end of the plug member 216, thereby coupling the plug member 216 to the mandrel 208. The setting rod 214 can be connected to the plug member 216 via a frangible connection such as threaded connection 234 or any other suitable connection device. The setting rod 214 and plug member 216 are coupled such that a tensile force applied along the longitudinal axis of the setting rod 214 and plug member 216 above a selected rupture threshold will break the connection (e.g., the threaded connection 234) between them and allow them to separate from each other.

The frac plug system 204 further includes a slip 218, setting cone 220, and bottom sub 222. The bottom sub 222 is coupled to a bottom end of the plug member 216. The setting cone 220 is disposed between the housing 210 and the slip 218. The slip 218 and setting cone 220 each have a bore therethrough. Plug member 216 extends through each of these bores. The slip 218 has an inner surface 224 that conically tapers to forming a funnel shape. The setting cone 220 has an outer surface 226 that is conically tapered to fit within the inner surface 224 of the slip 218.

Once the frac plug system 204 is conveyed to a selected location, the setting tool 202 is activated to set the frac plug system 204. The housing 210 is moved axially downhole with respect to the mandrel 208 via the actuator 212. The mandrel 208 is stationary within the wellbore 104 and therefore also maintains the setting rod 214, plug member 216 and bottom sub 222 stationary in the wellbore 104. The housing 210 moves the setting cone 220 axially into the slip 218 such that the outer surface 226 of the setting cone 220 slides along the inner surface 224 of the slip 218. Since the slip 218 is constrained from axial movement by the bottom sub 222, the setting cone 220 expands the slip 218 radially outward, securing the slip 218 in the casing 114. The slip 218 can include a slip ring 228 and elastomer seal 230 to seal a coupling between the slip 218 and the casing 114. The setting cone 220 becomes lodged within the slip 218 in its expanded state, thereby forming a frac plug. Once the setting cone 220 and slip 218 are secured in place in the wellbore 104, an upward force is applied to the mandrel 208 above the rupture threshold to separate the setting rod 214 from the plug member 216. The setting tool 202, including setting rod 214, is then run uphole.

A retainer 232 secures the plug member 216 within the setting cone 220 as the frac plug system 204 is being deployed downhole. The retainer 232 can be a device that holds the plug member 216 within the setting cone 220 once the setting cone 220 has been set to form the frac plug. The retainer 232 holds the plug member 216 at a position within the setting cone 220 to maintain the plug seal 308 at a distance from the setting cone 220 until a rate of fluid flowing through the setting cone 220 is greater than a selected flow rate threshold. When the fluid flow rate is above the flow rate threshold, the retainer 232 releases the plug member 216, which moves to place the plug seal 308 in contact with the setting cone 220, thereby closing the passage through the setting cone 220. Flow of fluid generally creates a pressure differential across the setting cone 220 to cause motion of the plug member 216. This pressure differential can be based on flow rate as well as fluid density and fluid viscosity.

In various embodiments, the retainer 232 can be a spring, a magnetic device, a shear pin or shear ring, a string, etc. In various embodiments, the retainer 232 can be reset once it has been released. Thus, the plug member 216 can be reset to its initial position within the setting cone 220 using the retainer 232 at a subsequent time after it has been released from this initial position.

Figure 3:
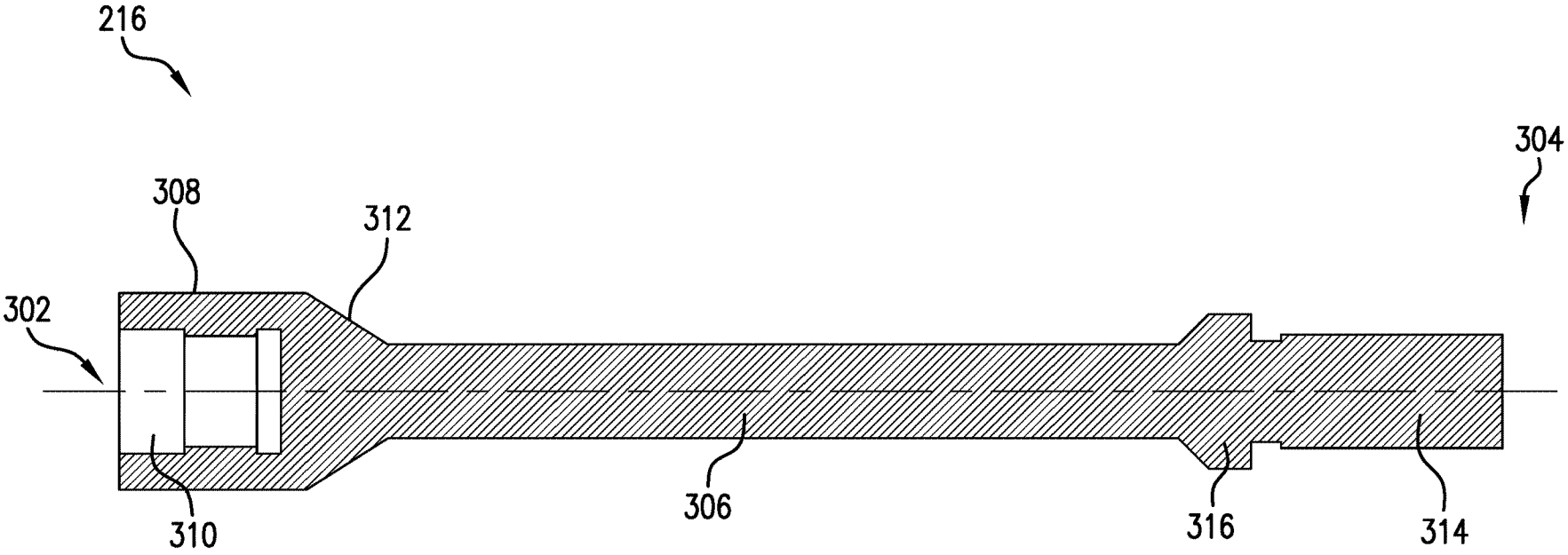
FIG. 3 shows a plug member of the downhole tool.

FIG. 3 shows the plug member 216 in an illustrative embodiment. The plug member 216 includes a first end 302, second end 304 and a middle section 306 that connects the first end 302 to the second end 304. The middle section 306 includes a rod or rod-like member having a first outer diameter. The first diameter is less than a diameter of the bores of the slip 218 and setting cone 220, allowing the middle section 306 to move axially with the bores once the frac plug system 204 has been set.

The first end 302 of the plug member 216 includes a plug seal 308. The plug seal 308 has a second outer diameter greater than the first outer dimeter of the middle section 306. The plug seal 308 includes a bore 310 for receiving the setting rod 214. In various embodiments, the bore 310 can include threads for threaded attachment of the setting rod 214. A tapered surface 312 between the plug seal 308 and the middle section 306 tapers from the second outer diameter at the plug seal 308 to the first outer diameter at the middle section 306. The second end 304 of the plug member 216 includes a threaded section 314 for threaded attachment to the bottom sub 222. A flange 316 provides a stop for the bottom sub 222. The second end 304 can have passages therein for fluid flow.

Figure 4:
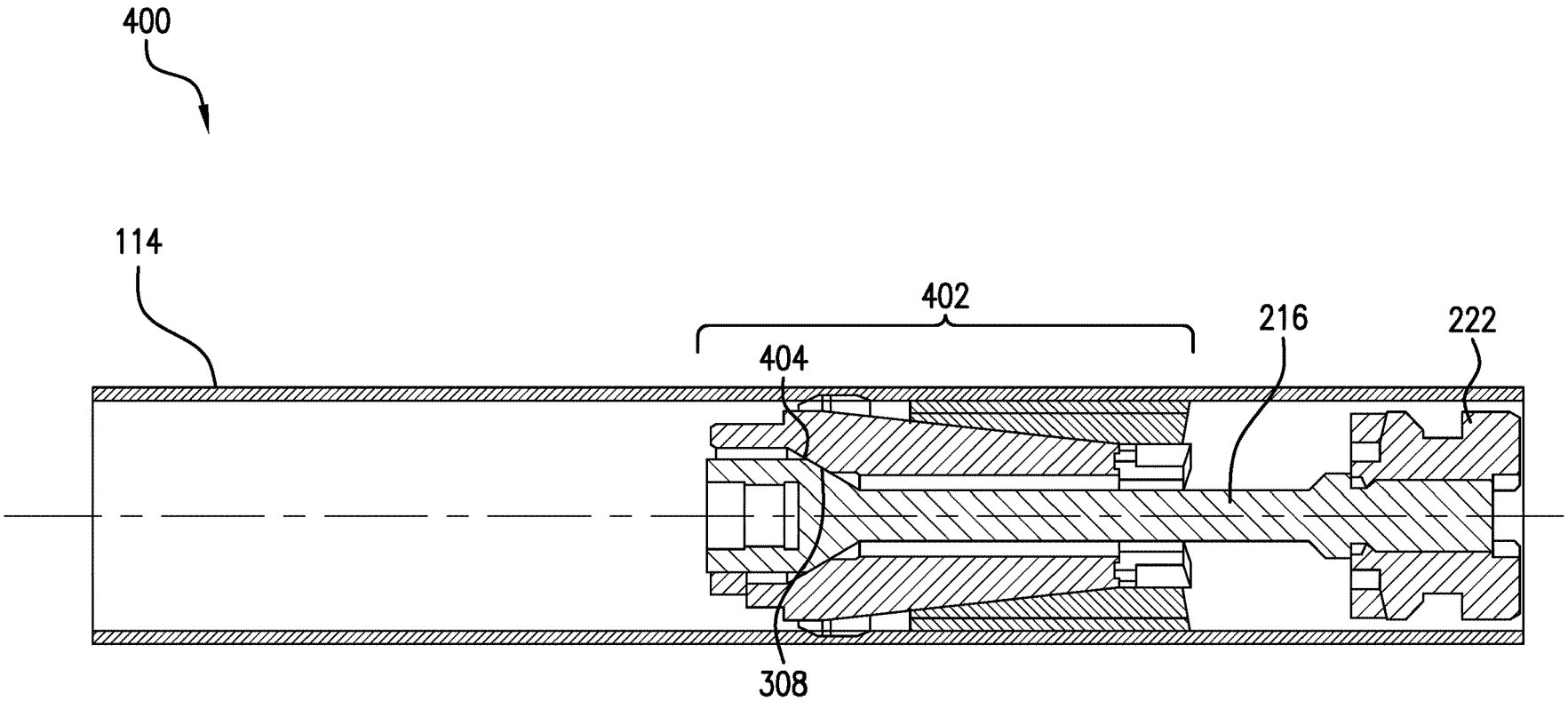
FIG. 4 shows a detailed view of a frac plug system in a first configuration.

FIG. 4 shows a detailed view 400 of the frac plug system 204 once the setting tool 202 has been removed in a first configuration in which a downward fluid pressure is applied at the frac plug system 204. The downward fluid pressure is due to flow of fluid in a first direction (i.e., downhole direction). Once the setting tool 202 has been removed, the setting cone 220 acts as a frac plug 402 with a ball seat 404 having a tapered inner surface for receiving the plug seal 308 of the plug member 216. The second diameter of the plug seal 308 is greater than the bore of the setting cone 220. The plug member 216 is disposed in the frac plug 402. The plug member 216 includes a sealing interface to seal flow when the plug seal 308 is disposed in the frac plug 402. In in one embodiment, the sealing interface is formed by a tapered surface 312 of the plug seal 308 having a tapering angle that matches or substantially matches a tapering angle of the ball seat 404 of the frac plug 402, thereby allowing a seal to be formed between the plug seal 308 and ball seat 404 when a downward fluid pressure is present. In other embodiments, the sealing interface can include a flat face seal, an elastomeric seal, a non-elastomeric seal face, etc. The plug member 216 closes a passage through the frac plug 402 for fluid flowing from above the frac plug to below the frac plug. The plug member 216 therefore closes the passage during pumping of a frac fluid in a frac treatment process.

Figure 5:
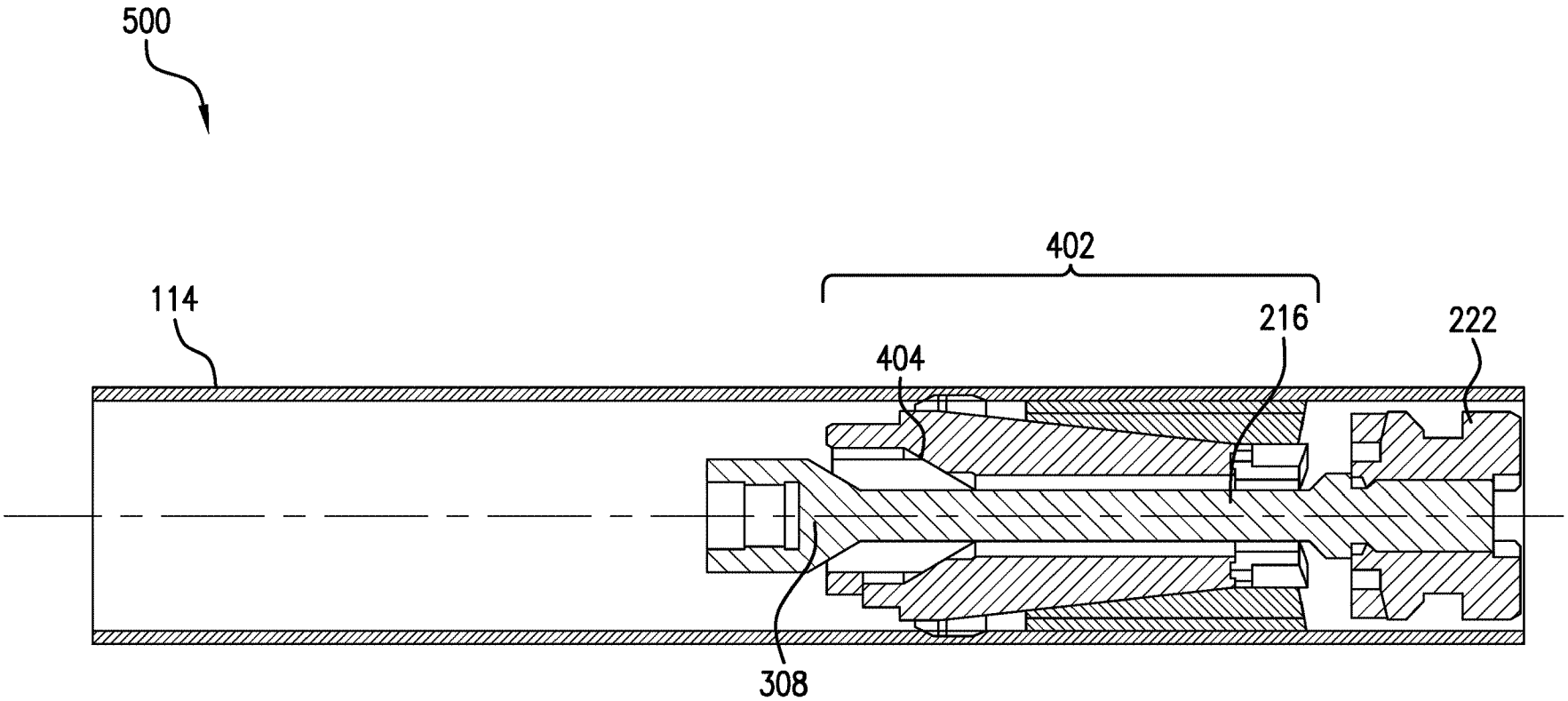
FIG. 5 shows a detailed view of the frac plug system in a second configuration.

FIG. 5 shows a detailed view 500 of the frac plug system 204 in a second configuration in the presence of an flowback. The flowback is a flow of fluid in a second direction (e.g., uphole direction) opposite the first direction and provide a fluid pressure directed in the uphole direction. The plug seal 308 is raised out of the frac plug 402 due to the flowback. The bottom sub 222 has a greater outer diameter than the diameter of the bore of the setting cone 220 and therefore limits the upward extent of the plug seal 308 from the frac plug 402. Fluid flow though the passages in the second end 304 of the plug member 216 to pass through the setting cone 220. Therefore, from FIG. 4 and FIG. 5, the frac plug system 204 controls, prevents or resists flow of fluid in a first direction (i.e., downhole direction) and allows fluid to flow during flowback (i.e., in the second direction). The plug member 216 is maintained within the frac plug 402 during flow back and is prevented from being carried away from the frac plug 402.

Figure 6:
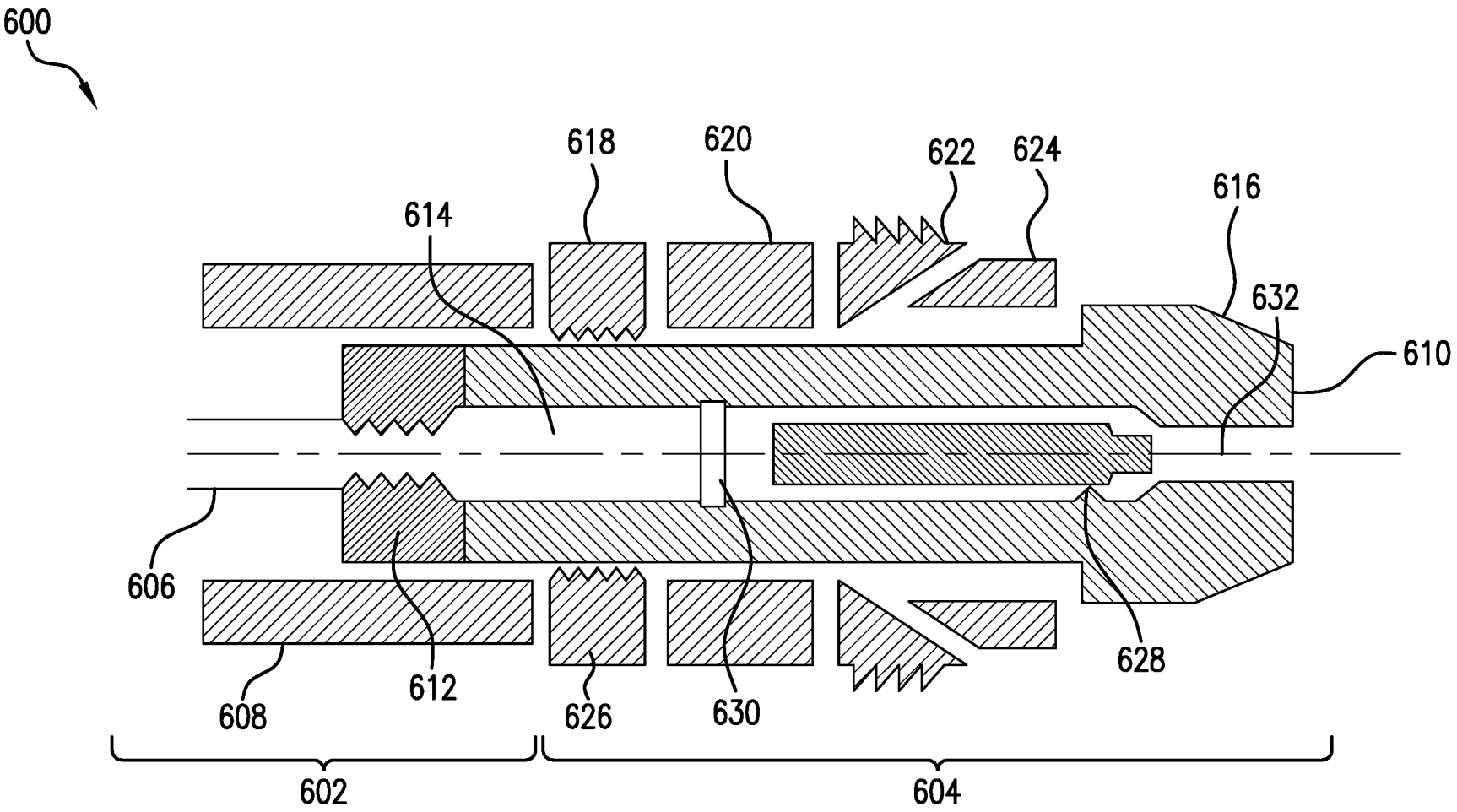
FIG. 6 shows a detailed view of the downhole tool, in an alternate embodiment.

FIG. 6 shows a detailed view 600 of a setting tool 602 and a frac plug system 604 of a downhole tool, in an alternate embodiment. During deployment, the frac plug system 204 is conveyed to a selected location in the wellbore 104 at a bottom end of the setting tool 602. The setting tool 602 is then controlled to install the frac plug system 604 in the wellbore 104. The setting tool 602 can then separate itself from the frac plug system 604, once the frac plug system 604 is installed, to leave the frac plug system 604 at the selected location in the wellbore 104.

The setting tool 602 includes a setting rod 606 and a setting housing 608, both aligned along a longitudinal axis of the downhole tool 112. The setting rod 606 is connected to a running tool (not shown). An actuator (not shown) can be operated to move the setting housing 608 along a longitudinal axis with respect to the setting rod 606.

The frac plug system 604 includes a body 610. The body 610 includes a hollow bore 614 extending longitudinally through the body and a flanged bottom end 616. The hollow bore 614 includes a restriction 632 at or near the flanged bottom end 616. A mandrel 628 is disposed within the hollow bore 614 and serves as a plug member during fluid operation once the frac plug system 604 is set downhole. A retainer pin 630 is located within the hollow bore 614 at a location nearer a first end or uphole end of the body than the mandrel 628. The mandrel 628 is contained within the hollow bore 614 via the retainer pin 630 and the restriction 632. The body 610 is coupled to the setting rod 606 via a frangible connection 612. The mandrel 628 is not coupled to the setting rod 606 and need not included a load path of the setting rod.

A packer 618, a packing element 620, a slip 622 and a cone 624 circumferentially surround the body 610 above the flanged bottom end 616. The packer 618, packing element 620, slip 622 and cone 624 are confined on the body 610 by the flanged bottom end 616 and the setting housing 608. Once the frac plug system 604 is conveyed to a selected location, the setting tool 602 is activated to set the frac plug system 604. The setting rod 606 maintains the body 610 stationary in the wellbore 104 while the setting housing 608 is moved axially in a downhole direction with respect to the setting rod 606. The setting housing 608 therefore moves against the packer 618, which moves against the packing element 620, which moves against the slip 622, which moves against the cone 624. The cone 624 is limited in its downward motion by the flanged bottom end 616 of the body 610. As the setting housing 608 moves downhole, the slip 622 slides along a sloped surface of the cone to expand radially outward and secure itself in the casing 114. The packing element 620 moves against the slip 622 and expands to form a seal between the body 610 and the casing 114. The packer 618 moves against the packing element 620 to form a secure connection with the body 610 via lock ring 626 of the packer 618.

Once the packer 618, packing element 620, slip 622 and cone 624 are secured in place, the body 610 is secured within the casing. An upward force applied to the setting rod 606 then ruptures the frangible connection 612 between the setting rod 606 and the body 610, allowing the setting tool 602 to be withdrawn out of the wellbore and leaving the frac plug system 604 in place in the wellbore.

Once the setting tool 602 is removed, fluid is allowed to flow through the body 610, and the mandrel 628 is able to move with the hollow bore 614 to control fluid flow through the body. A downward pressure resulting from a downward flow of fluid pushes the mandrel 628 into the restriction 632, thereby plugging the restriction and stopping further downward fluid flow. An upward pressure resulting from an upward flow of fluid pushes the mandrel out of the restriction 632, thereby allowing the upward fluid flow. The retainer pin 630 prevents the mandrel 628 from flowing out of the top or first end of the body 610. Set forth below are some embodiments of the foregoing disclosure:

Embodiment 1: A frac plug system for use in a wellbore, including a frac plug; and a plug member configured to set the frac plug in the wellbore and to control a flow of fluid through the frac plug once the frac plug is set in the wellbore.

Embodiment 2: The frac plug system as in any prior embodiment, wherein the plug member comprises a plug seal at a first end for controlling the flow of fluid through the frac plug.

Embodiment 3: The frac plug system as in any prior embodiment, wherein the plug member further comprises a second end coupled to a bottom sub for setting the frac plug in the wellbore.

Embodiment 4: The frac plug system as in any prior embodiment, wherein the bottom sub maintains the plug member within the frac plug during flowback.

Embodiment 5: The frac plug system as in any prior embodiment, wherein the plug seal has a sealing interface that forms a seal with a ball seat of the frac plug.

Embodiment 6: The frac plug system as in any prior embodiment, wherein the plug seal comprises a frangible connection for coupling the plug member to a setting rod while the frac plug is being deployed in the wellbore.

Embodiment 7: The frac plug system as in any prior embodiment, wherein the frangible connection is configured to break upon application of a tensile force between the plug member and the setting rod above a rupture threshold of the frangible connection.

Embodiment 8: The frac plug system as in any prior embodiment, wherein a body of the frac plug is coupled to the setting rod via a frangible connection while the frac plug is being deployed in the wellbore.

Embodiment 9: The frac plug system as in any prior embodiment, further comprising a retainer configured to secure the plug member in the frac plug during deployment, the retainer configured to release the plug member from the frac plug when a flow rate of the fluid through the frac plug is above a selected flow rate threshold.

Embodiment 10: The frac plug system as in any prior embodiment, wherein the plug member controls the flow of fluid by performing at least one of: (i) closing a flow path for the flow of fluid in a direction from above the frac plug to below the frac plug; (ii) opening a flow path for the flow of fluid in a direction from below the frac plug to above the frac plug; and (iii) closing the frac plug during the pumping of a frac fluid.

Embodiment 11: A method of controlling a flow of fluid within a wellbore, including conveying a frac plug system in the wellbore, the frac plug system including a frac plug and a plug member; setting the frac plug in the wellbore using the plug member; and control the flow of fluid through the frac plug using the plug member once the frac plug is set in the wellbore.

Embodiment 12: The method as in any prior embodiment, further comprising controlling the flow of fluid in a first direction via a plug seal at a first end of the plug member.

Embodiment 13: The method as in any prior embodiment, further comprising setting the frac plug and controlling the flow of fluid in a second direction via a bottom sub coupled to a second end of the plug member.

Embodiment 14: The method as in any prior embodiment, further comprising maintaining the plug member within the frac plug via the bottom sub during the flow of fluid in the second direction.

Embodiment 15: The method as in any prior embodiment, wherein the plug seal has a sealing interface that forms a seal with a ball seat of the frac plug.

Embodiment 16: The method as in any prior embodiment, further comprising coupling the plug seal to a setting rod via a frangible connection while the frac plug is conveyed into the wellbore.

Embodiment 17: The method as in any prior embodiment, further comprising breaking the frangible connection upon application of a tensile force between the plug member and the setting rod above a rupture threshold of the frangible connection after the frac plug has been set in the wellbore.

Embodiment 18: The method as in any prior embodiment, further comprising coupling a body of the frac plug to the setting rod via a frangible connection while the frac plug is being deployed in the wellbore.

Embodiment 19: The method as in any prior embodiment, further comprising securing the plug member in the frac plug during deployment via a retainer and releasing the plug member from the frac plug via the retainer when a flow rate of the fluid through the frac plug is above a selected flow rate threshold.

Embodiment 20: The method as in any prior embodiment, further comprising controlling the flow of fluid by performing at least one of: (i) closing a flow path for the flow of fluid in a direction from above the frac plug to below the frac plug; (ii) opening a flow path for the flow of fluid in a direction from below the frac plug to above the frac plug; and (iii) closing the frac plug during the pumping of a frac fluid.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A frac plug system for use in a wellbore, comprising:

a frac plug including a slip and a setting cone; and a plug member configured to be held stationary in the wellbore via a setting rod to constrain axial movement of the slip during setting of the frac plug while allowing axial movement of the setting cone against the slip to set the frac plug in the wellbore, wherein the plug member is releasable from the setting rod once the frac plug is set in the wellbore, wherein once the plug member is released, the plug member is maintained within the frac plug and moves within the frac plug to control a flow of fluid through the frac plug, wherein the plug member comprises a plug seal at a first end for controlling the flow of fluid through the frac plug, the plug seal comprising a frangible connection for coupling the plug member to the setting rod while the frac plug is being deployed in the wellbore.

2. The frac plug system of claim 1, further comprising a bottom sub coupled to a second end of the plug member, wherein the bottom sub constrains the axial movement of the slip during setting of the frac plug in the wellbore.

3. The frac plug system of claim 2, wherein, once the plug member is released, the bottom sub limits a motion of the plug member toward the first end during the flow of the fluid through the frac plug from the second end to the first end.

4. The frac plug system of claim 1, wherein the plug seal has a sealing interface that forms a seal with a ball seat of the frac plug.

5. The frac plug system of claim 1, wherein the frangible connection is configured to break upon application of a tensile force between the plug member and the setting rod above a rupture threshold of the frangible connection.

6. The frac plug system of claim 1, wherein a body of the frac plug is coupled to a setting rod via a frangible connection while the frac plug is being deployed in the wellbore.

7. The frac plug system of claim 1, further comprising a retainer configured to secure the plug member in the frac plug during deployment, the retainer configured to release the plug member from the frac plug when a flow rate of the fluid through the frac plug is above a selected flow rate threshold.

8. The frac plug system of claim 1, wherein the plug member controls the flow of fluid by performing at least one of: (i) closing a flow path for the flow of fluid in a direction from above the frac plug to below the frac plug; (ii) opening a flow path for the flow of fluid in a direction from below the frac plug to above the frac plug; and (iii) closing the frac plug during the pumping of a frac fluid.

9. A method of controlling a flow of fluid within a wellbore, comprising:

conveying a frac plug system in the wellbore, the frac plug system including a frac plug and a plug member, the frac plug including a slip and a setting cone, the plug member having seal at a first end;

coupling the plug seal to a setting rod via a frangible connection while the frac plug is conveyed into the wellbore;

constraining an axial movement of the slip via the plug member and the setting rod as the setting cone moves against the slip to set the frac plug in the wellbore;

releasing the plug member from the setting rod after the frac plug is set in the wellbore;

maintaining the plug member within the frac plug once the plug member is released while allowing the plug member to move within the frac plug to control a flow of fluid through the frac plug; and controlling the flow of fluid in a first direction via the plug seal.

10. The method of claim 9, wherein the plug member is coupled to a bottom sub, further comprising constraining the axial movement of the slip during setting the frac plug via the bottom sub.

11. The method of claim 10, further comprising limiting a motion of the plug member, once released, toward a first end during the flow of the fluid through the frac plug from a second end to the first end via the bottom sub.

12. The method of claim 9, wherein the plug seal has a sealing interface that forms a seal with a ball seat of the frac plug.

13. The method of claim 9, further comprising breaking the frangible connection upon application of a tensile force between the plug member and the setting rod above a rupture threshold of the frangible connection after the frac plug has been set in the wellbore.

14. The method of claim 9, further comprising coupling a body of the frac plug to the setting rod via a frangible connection while the frac plug is being deployed in the wellbore.

15. The method of claim 9, further comprising securing the plug member in the frac plug during deployment via a retainer and releasing the plug member from the frac plug via the retainer when a flow rate of the fluid through the frac plug is above a selected flow rate threshold.

16. The method of claim 9, further comprising controlling the flow of fluid by performing at least one of: (i) closing a flow path for the flow of fluid in a direction from above the frac plug to below the frac plug; (ii) opening a flow path for the flow of fluid in a direction from below the frac plug to above the frac plug; and (iii) closing the frac plug during the pumping of a frac fluid.

* * * * *